United States Patent [19]

Kuehlhorn

[11] 4,088,262

[45] May 9, 1978

[54] CARTON FOR ARTICLES OF VARYING SIZES

[76] Inventor: Bert O. Kuehlhorn, 4925 Indiana Ave., Lisle, Ill. 60532

[21] Appl. No.: 809,079

[22] Filed: Jun. 22, 1977

[51] Int. Cl.[2] ..... B65D 5/48

[52] U.S. Cl. ..... 229/27; 206/194; 206/431; 206/443; 229/44 R

[58] Field of Search ..... 229/15, 27, 28 BC, 42, 229/16 A, 44 R; 206/140, 193, 194, 197, 427, 431, 433, 443, 446

[56] References Cited

U.S. PATENT DOCUMENTS

| | | | |
|---|---|---|---|
| 2,531,090 | 11/1950 | Turner | 229/27 |
| 2,537,151 | 1/1951 | Mires | 229/27 |
| 3,357,630 | 12/1967 | Michelitsch | 229/45 |
| 3,362,610 | 1/1968 | Van Dyke | 229/15 |
| 3,390,783 | 7/1968 | Quackenbush, Jr. | 206/443 |
| 3,443,736 | 5/1969 | Steinbock | 229/15 |
| 3,899,119 | 8/1975 | Roccaforte | 229/15 |

*Primary Examiner*—William Price
*Assistant Examiner*—Bruce H. Bernstein
*Attorney, Agent, or Firm*—Edward C. Threedy

[57] ABSTRACT

A shipping and handling carton for varying size articles, such as bottles and the like, adapted to be formed from a single sheet of foldable material, such as corrugated paper. The carton is designed to provide a plurality of individual article-holding internal partitions, while providing complete exterior coverage for the articles therein.

4 Claims, 6 Drawing Figures

CARTON FOR ARTICLES OF VARYING SIZES

SUMMARY OF THE INVENTION

This invention relates to a shipping and handling carton of the type adapted to secure therein a plurality of articles having different sizes and dimensions.

Prior article-holding cartons usually were of the wrapper or wrap-around type wherein portions of the articles were exposed. This was normally the construction when the articles were of varying sizes, such as different heights and widths. It was a characteristic of the prior arrangements that in order to remove one of the articles, the entire wrapper or package was destroyed.

To achieve the objects of this invention, there is provided a rectangularly shaped article-holding carton which can be constructed from a single blank of foldable sheet material cut and scored to provide connecting side, end, and bottom walls, as well as a latchable top wall and interiorly disposed article-holding partitions.

The construction of the present invention provides the carton with a plurality of independent article-holding partitions whereby different size articles are individually secured within the carton. The article-holding partitions are separate from the reclosable top of the carton and, as such, the top cover may be employed to cooperate with the interior partitions to provide yet another separate available compartment.

GENERAL DESCRIPTION

The invention will be best understood by reference to the accompanying drawings showing the preferred form by which the objects of this invention are achieved, and in which.

Figure 1:
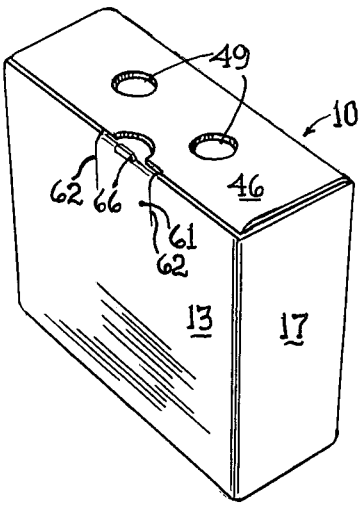
FIG. 1 is a perspective view of a fully assembled and closed carton.

The article-holding carton 10 is assembled from a single sheet of material 11 which is scored and cut to define rectangularly shaped side walls 12 and 13.

One end wall 14 has its longitudinal edges formed by fold lines 15 and 16 by which it is connected to side walls 12 and 13, respectively. The other end wall 17 is connected by a fold line 18 to an opposite edge of the side wall 13.

Bottom wall forming flaps 19, 20, 21 and 22 are by fold lines 23, 24, 25 and 26 connected to corresponding edges of the side walls 12 and 13 and end walls 14 and 17, respectively.

Figure 2:
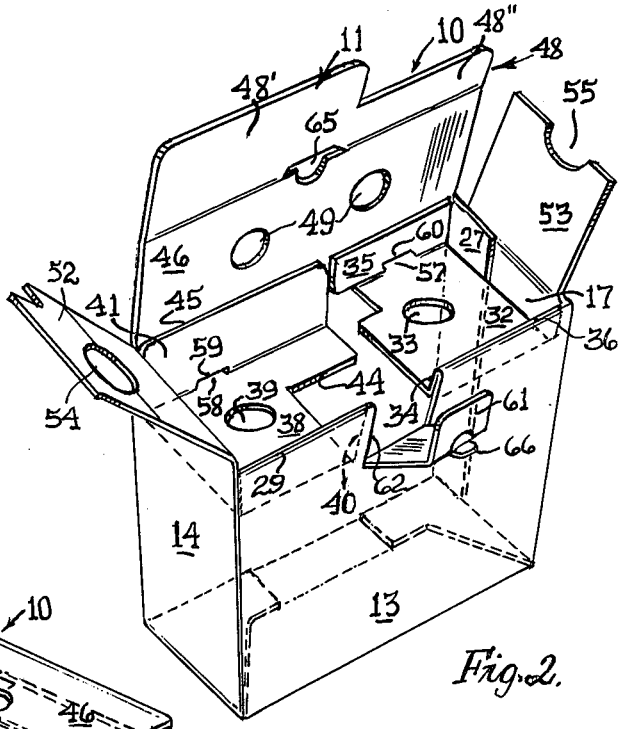
FIG. 2 is a perspective view of the carton with the top cover in an open position.
Figure 3:
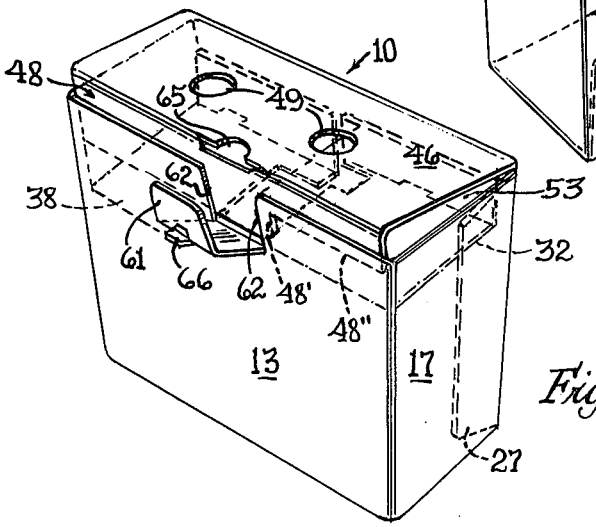
FIG. 3 is a perspective view of the carton showing the top cover in an unlatched condition.

An adhesive-bearing strip 27 is connected by a fold line 28 to the remaining longitudinal edge of the side wall 12 which, when the carton is in its assembled condition, will be adhesively fixed to the confronting inner wall surface of the end wall 17, as seen in FIGS. 2 and 3.

Figure 4:
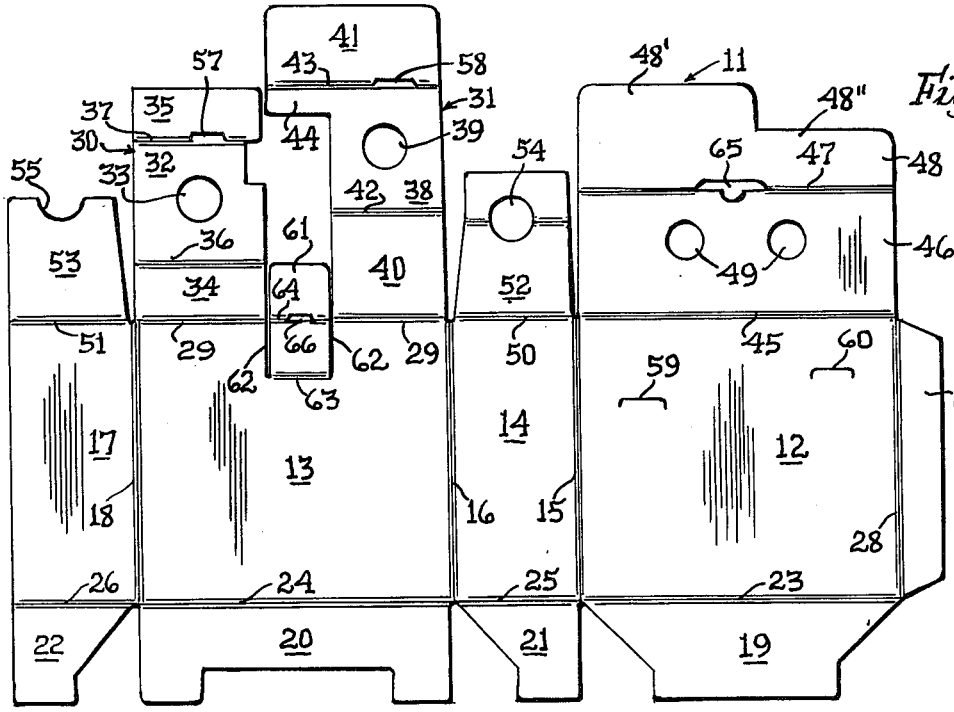
FIG. 4 is a plan view of the sheet of material from which the carton is constructed.

Extending from a fold line 29 which defines the top edge of the side wall 13 are individual partition-forming panels 30 and 31. The panel 30 is formed to provide a medial portion 32 provided with a center aperture 33. To either side of the medial portion 32 are drop walls 34 and 35, each defined from the medial portion 32 by fold lines 36 and 37, respectively. As seen in FIG. 4, the panel 31 is of a width less than one-half the width of the side wall 13 and is completely separated so as to be independent of the partition-forming panel 31.

The panel 31 provides a medial portion 38 which has formed therein a center aperture 39. To either side of the medial portion 38 of the panel 31 are drop walls 40 and 41, each defined from the medial portion 38 by fold lines 42 and 43, respectively.

It should be noted that a section of the medial portion 38 of the panel 31 adjacent to the fold line 43, has a lateral extension 44 which is adapted to terminate in confronting relation to one side edge of the drop wall 35 of the partition-forming panel 30. The drop wall 41 is of a width corresponding to the combined width of the medial portion 38 and the lateral extension 44.

It should also be noted that the drop walls 40 and 41 of the panel 31 are of a length twice that of the drop walls 34 and 35 of the panel 30, so as to extend laterally therebeyond from the fold line 29, for a purpose hereinafter made apparent.

Connected to an edge of the side wall 12 by a fold line 45, is a top wall 46. Extending laterally therefrom beyond a fold line 47 is an insert flap 48. The top wall 46 has formed therein a pair of apertures 49 which become finger-receiving grip portions when the carton is in its fully assembled condition as viewed in FIG. 1.

Extending laterally from fold lines 50 and 51 formed at one edge of the end walls 14 and 17, are reinforcing flaps 52 and 53. The flap 52 is provided with an aperture 54, while the free edge of the flap 53 is provided with a circular notch 55, all for a purpose and function which will be hereinafter made apparent.

Figure 5:
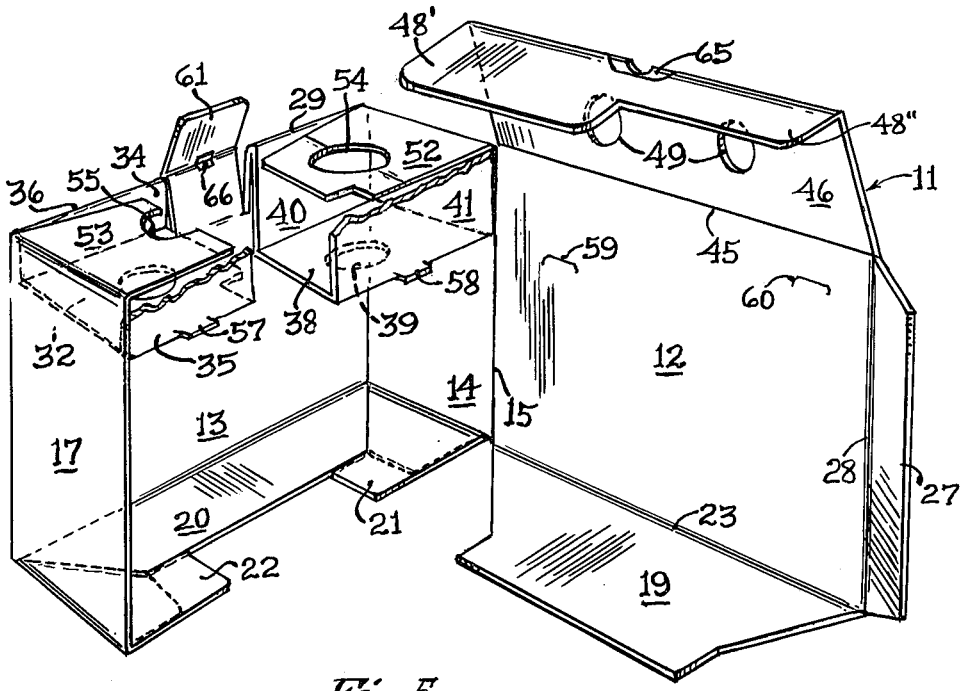
FIG. 5 is a perspective view of the carton with one of the side walls thereof displaced in an unassembled position.

In assembling the carton 10 from the blank of material 11, the side walls 12 and 13, together with the end walls 14 and 17, are folded so as to form a rectangularly shaped housing. The botton wall forming flaps 19, 20, 21 and 22 are caused to overlap each other in the manner shown in FIGS. 5 and 6, so as to provide a composite bottom wall 56 for the carton, as shown in FIG. 6.

When the carton 10 is assembled as described above it will provide an open-top rectangularly shaped housing which will receive the individual partition-forming panels 30 and 31.

Figure 6:
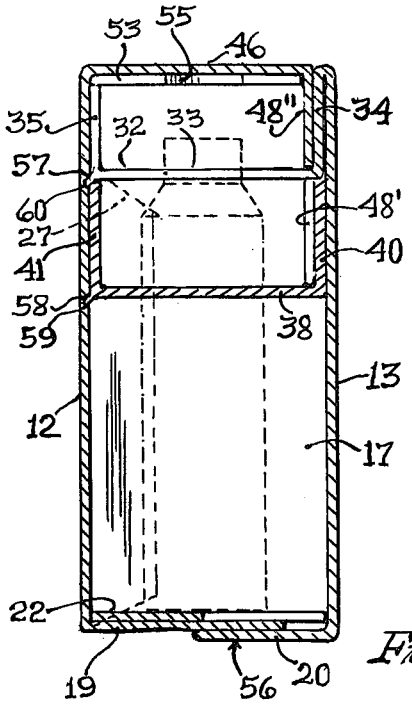
FIG. 6 is a side elevational detailed sectional view showing the interior of the carton in fully assembled and closed condition.

Prior to the complete assembly of the carton 10, articles, such, for example, as bottles, may be placed therein so as to sit upon the interior surface of the bottom wall 56, as shown in FIG. 6. Such bottles may be of varying heights and, as such, the individual partition-forming panels 30 and 31 may be used to accommodate holding the same within the carton 10.

With the bottles placed through the open top into the carton 10, the partition-forming panels 30 and 31 are then assembled in the following manner: First, the drop walls 34 and 40 of the panels 30 and 31, respectively, are bent along the fold lines 29 so as to lie in facial abutment with the inner wall surface of the side wall 13. The medial portions 32 and 38 of the panels 30 and 31, respectively, are then reversely bent along the respective fold lines 36 and 42 so as to proceed across the width of the carton 10 until they approach the inner wall surface of the side wall 12. The neck of the bottles may be projected through the apertures 33 and 39 formed in the medial portions 32 and 38 of the partition-forming panels 30 and 31. The remaining drop walls 35 and 41 of the panels 30 and 31, respectively, are then reversely bent along fold lines 37 and 43 so as to abut the upper portion of the inner wall surface of the side wall 12, as clearly shown in FIG. 6.

To secure the medial portions 32 and 38 of the panels 30 and 31 in their transversely extending plane between the side walls 12 and 13, there is formed in each of the fold lines 37 and 43 thereof a notched tab 57 and 58, respectively. These tabs 57 and 58 are adapted to be respectively frictionally inserted into like notched recesses 59 and 60 formed in the inner wall surface of the side wall 12.

By this arrangement, bottles or the like of varying heights are securely held within the interior of the carton 10.

To complete the assembly, the reinforcing end flaps 52 and 53 are bent inwardly along their fold lines 50 and 51. The top wall 46 may be then hinged about its fold line 45 and the insert flap 48 hinged about its fold line 47 such that the top wall 46 will close the carton 10, while the insert flap 48 will be inserted within and in facial abutment with the inner wall surface of the side wall 13, as shown in FIG. 3.

The insert flap 48 is so formed as to provide an enlarged section 48', which has a width equal to the width of drop wall 40, and a reduced portion 48" equal in width to the width of the drop wall 34, so that when they are assembled in a closed position, the free edges of the portions 48' and 48" will abut against the medial portions 32 and 38 of the panels 30 and 31 to hold the same in assembled position.

When the top wall 46 is in its assembled closed position, it is readily apparent that there is provided within the carton 10 between the top wall 46 and the medial portions 32 and 38 of the partition-forming panels 30 and 31, a compartment which may accept additional items associated with the bottles, such as pouring spouts, replaceable caps, etc.

To secure the top wall 46 in its closed position with respect to the assembled carton 10, there is provided a latch tab 61. As shown in FIG. 4, this latch tab 61 is formed partially out of the side wall 13 and from a remainder of the material found between the drop walls 40 and 40 of the partition-forming flaps 30 and 31. The latch tab 61 is defined by longitudinal cut lines 62 and by fold lines 63 and 64.

As shown in FIGS. 2 and 3, when the carton is being closed by the top wall 46, the latch tab 61 is hinged along fold lines 63 into a plane away from the open top of the carton 10 for the purpose of permitting the top wall 46 and insert flap 48 from being displaced from assembled condition as shown in FIG. 3. When the top wall 46 is in its assembled position, the latch tab 61 is then bent about fold line 64 so that the free end thereof may be projected into a receiving slot 65 formed in the fold line 47 between the top wall 46 and the insert flap 48. In such position, the parts will assume the relationship shown in FIG. 1 and, as such, the carton 10 will be completely closed and latched, with the articles secured and completely encased therein and the carton 10 may be readily carried through the finger-gripping apertures 49 formed in the top wall 46, as shown.

For convenience in releasing the latch tab 61, there is struck from the medial portion thereof along its fold line 63 a gripping tab 66. This tab is readily available, as seen in FIGS. 1 and 2.

From the foregoing, it is apparent that there has been described a carton which is adapted to contain and securely hold therein a plurality of products of varying sizes. The carton as described also provides an auxiliary compartment, with all of the articles completely encased within the container when the latter is in its fully assembled and latched condition. It is readily apparent that the top wall 46 may be opened and the individual articles removed from the carton without complete destruction of the carton.

While I have illustrated and described the preferred form of construction for carrying my invention into effect, this is capable of variation and modification without departing from the spirit of the invention. I, therefore, do not wish to be limited to the precise details of construction set forth, but desire to avail myself of such variations and modifications as come within the scope of the appended claims.

Having thus described the invention, what I claim as new and desire to protect by Letters Patent is:

1. A shipping and handling carton for articles of varying sizes constructed from a sheet of blank material formed to provide an open-top carton comprising a. rectangularly arranged bottom, end and side walls secured together to form a normally open-top carton, b. a cover extending from one side wall and adapted to close the normally open top of the carton, c. latch means provided by the other side wall cooperating with means on said cover for releasably latching said cover in a closed position, d. partition members extending from said other side wall and connected thereto by a fold line about which said members are hingedly disposed within said carton, said members comprising separate panels each providing depending wall portions adapted to have facial abutment with the inner wall surfaces of said side walls, and a medial portion between said side walls and extending at right angles thereto, with the wall portions of one of said partition members being of a length greater than the length of the other wall portion of said other partition member so as to dispose the medial portion thereof in a different plane transversely between said side walls, e. article - securing means formed in said portions of said partition members for independently securing articles of different heights within said carton, and f. means provided by said portions cooperating with means provided by said one side wall for retaining said portions in their transverse plain between said side walls.

2. A shipping and handling carton as defined by claim 1 wherein said transversely extending portions of said partition members are of a length equal to the width between said side walls and spaced inwardly of said cover so as to form within said carton an article-holding compartment.

3. A shipping and handling carton as defined by claim 2 wherein said means provided by said medial portions of said partition members comprise tabs struck from the line of junction between said medial portions and certain of said depending wall portions, with said tabs adapted to be frictionally projected into staggered recesses formed in the inner surface of said one side wall for retaining said medial portions in different planes transversely between said side walls of said carton.

4. A shipping and handling carton as defined by claim 1 wherein said means provided by said medial portions of said partition members comprise tabs struck from the line of junction between said medial portions and certain of said depending wall portions, with said tabs adapted to be frictionally projected into staggered recesses formed in the inner surface of said one side wall for retaining said medial portions in different planes transversely between said side walls of said carton.

* * * * *